United States Patent [19]

Yamaguchi

[11] Patent Number: 4,516,630

[45] Date of Patent: May 14, 1985

[54] MOTORCYCLE RADIATOR

[75] Inventor: Ken Yamaguchi, Saitama, Japan

[73] Assignee: Honda Giken Kogyo Kabushiki Kaisha, Tokyo, Japan

[21] Appl. No.: 517,299

[22] Filed: Jul. 26, 1983

[30] Foreign Application Priority Data

Jul. 27, 1982 [JP] Japan ..... 57-113589[U]
Aug. 11, 1982 [JP] Japan ..... 57-121868[U]

[51] Int. Cl.[3] ..... F24H 3/00

[52] U.S. Cl. ..... 165/47; 165/139; 165/172; 123/41.57; 180/229

[58] Field of Search ..... 165/41, 47, 51, 139, 165/172; 123/41.55, 41.57; 180/229; 122/6 A

[56] References Cited

U.S. PATENT DOCUMENTS

| | | | |
|---|---|---|---|
| 1,813,079 | 7/1931 | Oppe | 165/51 |
| 1,853,331 | 4/1932 | Bates | 165/41 |
| 1,912,880 | 6/1933 | Bennett | 122/6 A |
| 3,033,534 | 5/1962 | Caughill et al. | 165/153 |
| 4,019,595 | 4/1977 | Imai et al. | 180/229 |
| 4,171,729 | 10/1979 | Shibata | 165/41 X |
| 4,180,137 | 12/1979 | Wagner | 180/229 |
| 4,296,805 | 10/1981 | Fleury | 165/175 X |
| 4,428,451 | 1/1984 | Yamaoka | 165/41 X |
| 4,445,587 | 5/1984 | Hillman | 165/51 X |

*Primary Examiner*—Sheldon J. Richter
*Assistant Examiner*—Randolph A. Smith
*Attorney, Agent, or Firm*—Pollock, Vande Sande & Priddy

[57] ABSTRACT

A heat exchange device for mounting between the front fork and the engine of a motorcycle comprises two vertical coolant outflow tanks on either side of a core area, and a coolant inflow tank located midway between the outflow tanks and connected to the latter. The lower part of the device comprises a series of bent tubes having cooling fins therebetween, to form an inverted U-shaped space which straddles the top of the engine, so as to provide sufficient clearance to accommodate the expansion and contraction strokes of the front fork.

7 Claims, 6 Drawing Figures

FIG. 3
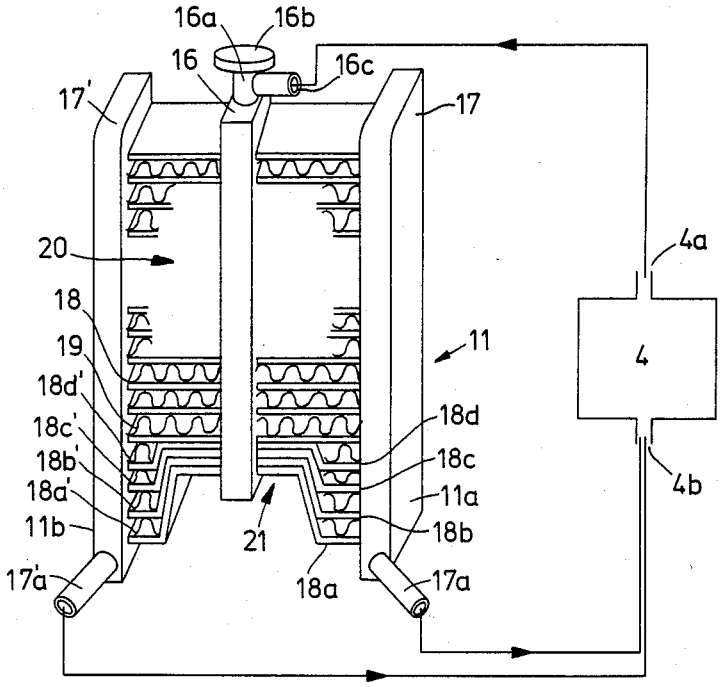
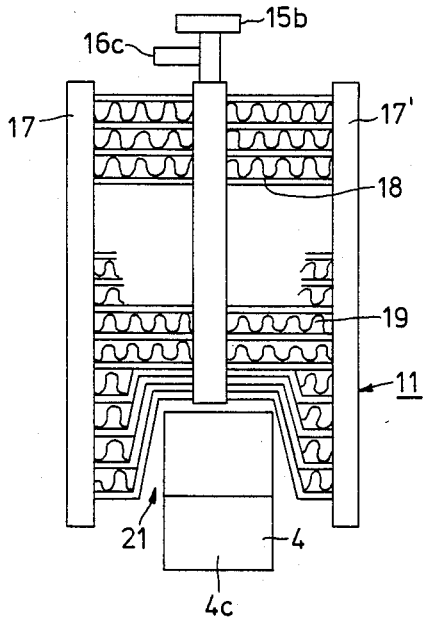
FIG. 4

FIG. 5
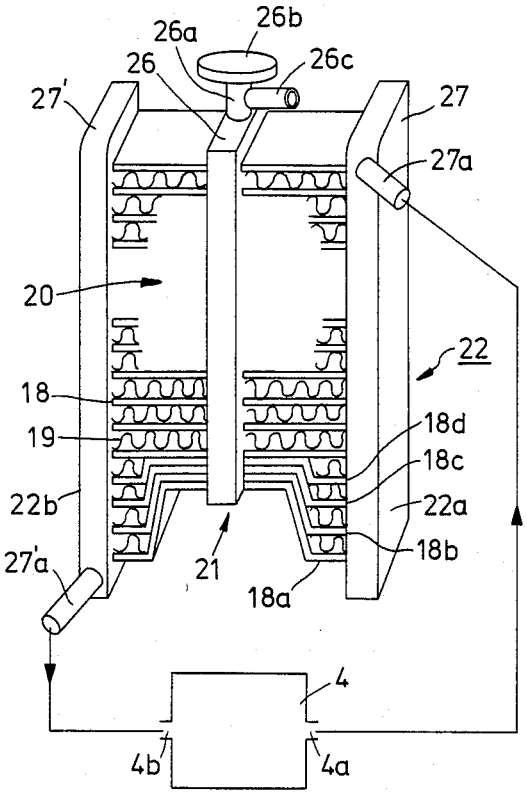
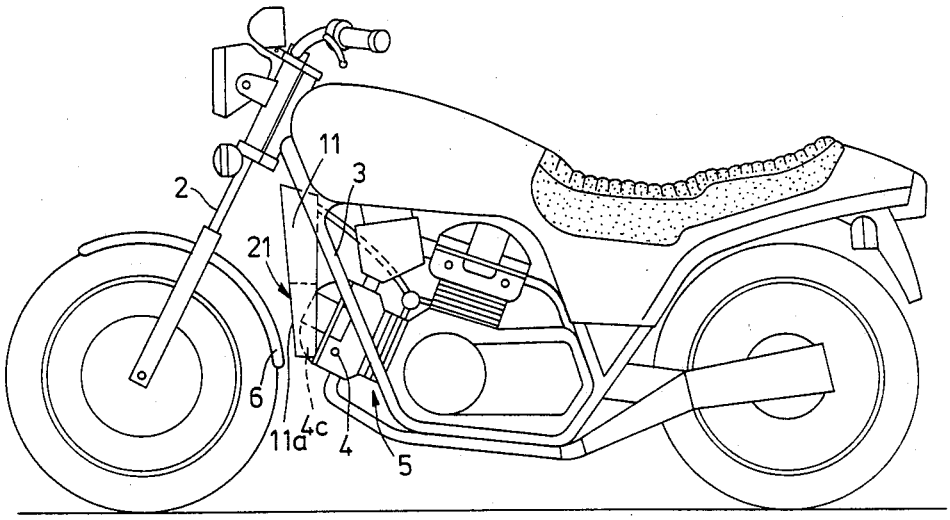
FIG. 6

MOTORCYCLE RADIATOR

SUMMARY OF THE INVENTION

The present invention relates to a heat exchange device to be mounted between the front fork and the engine of a motorcycle, and which has a lower escape section in the shape of an inverted U, formed of a series of bent tubes, providing a space for mounting the device so that it straddles the engine, and leaves enough clearance for the expansion and contraction strokes of the front fork.

BACKGROUND OF THE INVENTION

In motorcycles having water cooled engines, the space for accommodation of a radiator is rather limited, for reasons not only of dimensions, but also of cooling capacity, external appearance, and other considerations. Generally, the radiator is positioned between the front fork supporting the front wheel and the power unit of the engine supported by the motorcycle frame, and is fixed to the upper portion of the latter. The radiator normally comprises a core between two tanks for coolant inflow and coolant outflow, respectively. Within the core there are a number of tubes extending in various directions, forming a coolant circuit connecting the tanks, and fins to expand the cooling surface area are arranged between these tubes. Hoses connect the tanks to the coolant inlet and outlet of the engine, respectively. The radiator has a generally square cross section, and is somewhat wider than it is high. In order to increase the heat release effect, the heat release surface area is made as large as possible, and for reasons of appearance, especially in the case of motorcycles, the device preferably has a vertically elongated shape.

However, particularly in the case of V-type engine motorcycles, because the upper portion of the engine protrudes in front of the frame, the area between the front fork and the engine (i.e., the space between the front fender and the radiator) is narrow. Thus, if a vertically elongated box type radiator is used, the expansion and contraction strokes of the front fork cannot be properly accommodated. For this reason, when this type of radiator is to be used, the space between the front fork and the engine must be expanded, and a motorcycle with a V-type engine cannot be scaled down to a smaller size. On the other hand, if the expansion of this space is to be avoided, it then becomes necessary to obtain the required heat release surface area by designing the radiator in a horizontally elongated form. The result of this expedient is to sacrifice the external appearance of the motorcycle, making it impossible to produce a motorcycle having a body which is slim and of narrow width.

OBJECT OF THE INVENTION

An object of the present invention is a heat exchanger for motorcycles which overcomes the above-noted drawbacks while yet providing an ample heat release surface area.

BRIEF DESCRIPTION OF THE DRAWINGS

In order that the invention may be more clearly understood, reference will now be made to the accompanying drawings, in which several embodiments of the invention are shown for purposes of illustration, and in which:

FIG. 3 is a perspective view similar to FIG. 2, also partly schematic, showing the configuration of the radiator according to the present invention.

FIG. 4 is a front view generally corresponding to FIG. 3, showing the radiator according to the present invention in relation to the engine.

FIG. 5 is a perspective view similar to FIG. 3, showing another embodiment of the radiator according to the present invention.

FIG. 6 is a view of a motorcycle with the device according to the present invention installed thereon.

DESCRIPTION OF PREFERRED EMBODIMENT

Figure 1:
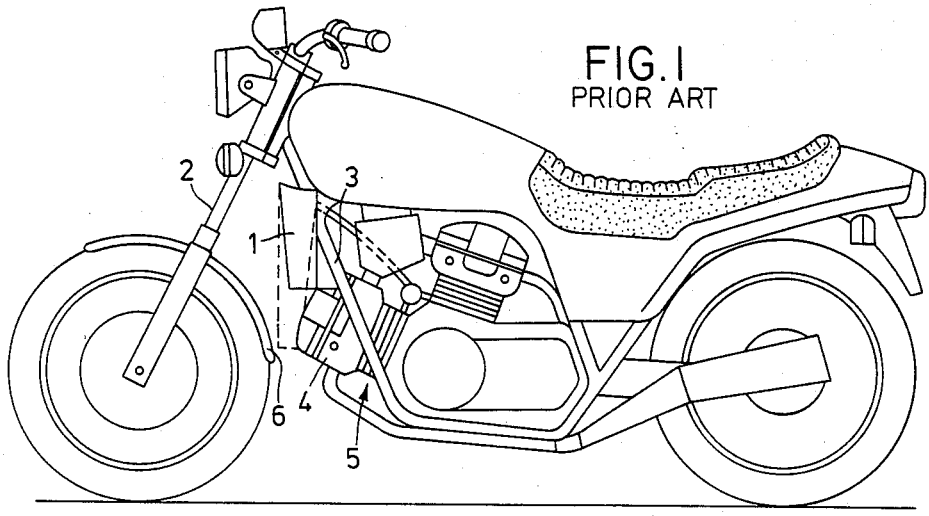
FIG. 1 PRIOR ART
FIG. 1 is a side view of a motorcycle with a V-type engine, provided with a radiator according to the prior art.
Figure 2:
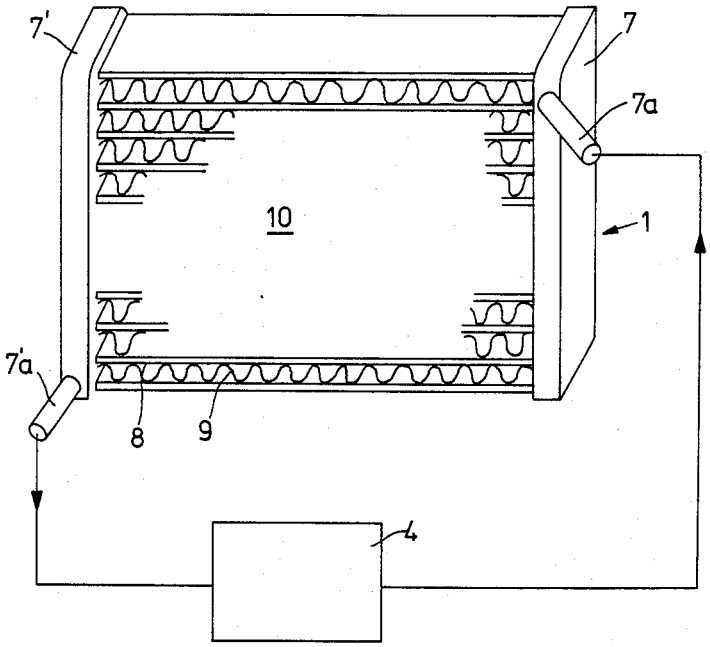
FIG. 2 PRIOR ART
FIG. 2 is a perspective view, partly schematic, showing the configuration of such prior art radiator.

In FIGS. 1 and 2, which relate to the prior art, the radiator 1 is located between the front fork 2, supporting the front wheel, and the power unit 5 of the engine 4, supported by the frame 3, and is fixed to the upper area of the frame 3. This radiator 1 comprises a core 10, with hose 7*a* connected to the engine coolant outlet (not shown), with fins 9 arranged to expand the surface area, between a number of tubes 8, in various directions, forming a coolant circuit connecting tanks 7 and 7', with tank 7 used for coolant inflow from the engine 4, and tank 7' used for coolant outflow to the engine 4, by means of hose 7'*a* connected to it and to the engine 4 coolant inlet (not shown). The body as a whole is in the form of a square box, somewhat wider than high. In order to increase the heat release effect for the radiator, the heat release surface area is made as large as possible, and, in terms of the external appearance of a motorcycle, the object preferably has a vertically elongated shape.

As will appear from FIG. 1, the top of the engine 4 sticks out in front of the frame 3, so that the area between the front fork 2 and the engine 4 (i.e., the space between the front fender 6 and the radiator 1) is narrow. If a vertically elongated box type radiator 1 is used (shown in broken lines), the full expansion and contraction strokes of the front fork 2 cannot be properly accommodated. This makes it necessary to expand the space between the front fork 2 and the engine 4, rendering downsizing of motorcycles with a V-type engine impossible. An alternative approach is to obtain the necessary heat release surface area by giving radiator 1 a horizontally elongated form. In this case, the external appearance of the vehicle body must be sacrificed, and this is undesirable because the market demands a motorcycle which has a slim body and a narrow width.

The present invention overcomes these disadvantages by means of a heat exchange device having a form appropriate to a motorcycle and offering an ample heat release effect, comprising two spaced tanks, with a connecting core therebetween, and a third tank, respectively connecting with the first two tanks, through the intermediary of the core, located at a predetermined position with respect to the core, so as to allow space for an escape section open at the bottom, of generally inverted U-shape, located at the bottom of the said third tank.

As shown in FIGS. 3 and 4, the heat exchange device (hereafter called the radiator) 11 comprises a coolant inflow tank 16, coolant outflow tanks 17 and 17', and a core 20, connecting with tank 16, the body as a whole being in a vertically elongated form. Tank 16 has a long, thin, boxlike form, provided at the top, more or less in the center, with a neck 16*a*, with a removable pressure cap 16*b* fitted thereto to permit regulation of the pressure inside the tank, as well as to extract air mixed in with the coolant. To the neck 16*a* is also attached one end of a hose 16*c*, the other end of which is connected to coolant outlet 4*a*, placed in the water jacket (not shown) of the engine 4, this hose being used for coolant inflow. Tanks 17 and 17' are arranged symmetrically at a predetermined distance on either side of tank 16, and are thinner and longer than tank 16, and also in more or less boxlike form. At their lower ends they have, respectively, hoses 17*a* and 17'*a* connected to them, the other end of each hose being connected to coolant inlet 4*b*, placed in the water jacket of the engine 4, these hoses being used for coolant outflow.

Core 20, on each side of tank 16, connects tanks 17 and 17', and also comprises a set number of flattened tubes 18, placed at predetermined intervals and extending more or less perpendicular to the tanks, and cooling fins 19, arranged in radiating form distributed among the tubes 18. Located below the top of central tank 16, or at the bottom of both sides of it, but above the bottoms of tanks 16, 17 and 17', among the core tubes 18 connecting the bottoms of tanks 16, 17 and 17', are eight tubes 18*a*–18*d*, and 18*a'*–18*d'*. As shown in FIG. 3, tubes 18*a'*–18*d'* are bent toward the bottom of tank 16, and these bends are symmetrically arranged. Thus, by means of these bends, a generally inverted U-shaped space 21 is formed. This space 21, for instance in the case of the previously mentioned radiator for use with a V-type engine, as shown in FIG. 4, should be big enough to be able to straddle the top 4*c* of the engine 4.

A radiator with this kind of structure may, for instance, be made of aluminum. In comparison with the use of copper, this permits the tube thickness to be made greater with the same weight, so that bending can be performed on the tubing more easily, and without damage to the tubing.

The coolant which is heated up from cooling the engine comes from coolant outlet 4*a*, and passes through hose 16*c* into the central tank 16, then through the tubes 18 of the core 20 on both sides of tank 16, and flows out to tanks 17 and 17'. As the coolant passes through the various tubes 18 of the core 20, heat is discharged by means of the surfaces of the tubes 18 and by the fins 19, and, as will be discussed subsequently, when installed in the vehicle, there is an interaction with the cooling effect as the vehicle moves through the air, and a heat discharge effect takes place for the radiator 11. As for the coolant which has flowed out into tanks 17 and 17', this coolant is returned to the water jacket of the engine 4 by means of a circuit made up of hoses 17*a* and 17'*a*, and coolant inlet 4*b*, and it again carries out cooling of the engine 4. In such a case, due to the heating of the coolant by the engine 4, air bubbles may be produced. With the present design, the portion where it is particularly easy for the air bubbles to build up, namely, the top of the bent portions of the tubes, has no build-up of air bubbles because of the installation of the tank 16, the bubbles being expelled via tank 16.

FIG. 5 is an illustration of another embodiment of a radiator according to the invention. In this case, the coolant inflow tank 27 and the coolant outflow tank 27' are installed on either side of the core of the radiator 22. Coolant inflow hose 27*a* is connected to the upper portion of tank 27, and coolant outflow hose 27'*a* is connected to the lower portion of tank 27', and, as shown in FIGS. 3 and 4 and discussed above, a tank 26 is connected in the approximate center of the core 20. On the top of this central tank 26, there is fitted metal neck 26*a*, with cap 26*b* fitted on it; neck 26*a*, by means of hose 26*c*, is connected to a reserve tank (not shown). As for its other structure and function, these are the same as with radiator 11 shown in FIG. 3.

Radiators with structures such as those of 11 and 22 are carried on motorcycles with V-type engines in the manner shown in FIG. 6. I.e., they are fastened to the frame 3 at set points, such as the upper areas of tanks 17 and 17', or 27 and 27'; and, by means of the space section 21 at the bottoms of radiators 11 and 22, the top 4*c* of the engine 4 is straddled (see FIG. 4). The two lower sides of the said radiators 11 or 22 are placed close to the sides of power unit 5, at points 11*a* and 11*b*, or 22*a* and 22*b* (see FIGS. 3, 4 and 5). As a result, the distance between front fender 6 and points 11*a* and 11*b* or 22*a* and 22*b* on the two lower sides of the radiators 11 or 22 is widened, and the stroke length of front fork 2 is fully accommodated. In addition, in the cases of vehicles having other than V-type engines, since an escape space is formed for the front fender due to space 21, even if the distance between the engine and the front fork is made narrower, reducing the scale of the vehicle, it is possible to amply accommodate the front fork stroke. As a consequence, since the design according to the invention provides for an increase in the core surface area on both sides of the space 21, it is possible to make the radiator as a whole proportionately narrower, making it suitable for motorcycles requiring a narrow and slim body.

It goes without saying that the radiator according to the invention may also be used as a cooling device for other fluids, e.g., engine lubrication oil.

What is claimed is:

1. Heat exchange device for mounting between the power unit and the front fork of a motorcycle, said device comprising an open space of generally inverted U shape in the bottom region of said device, said space being formed by a plurality of tubes bent so as to jointly form said generally inverted U shape, said bent tubes being located beneath a plurality of straight tubes and, together with said straight tubes, constituting the core of said device, whereby sufficient clearance is provided between the front fender of said motorcycle and said heat exchange device to accommodate the expansion and contraction strokes of said front fork.

2. Heat exchange device according to claim 1, comprising two vertical coolant outflow tanks on either side of a core area, and a vertical coolant inflow tank midway between said outflow tanks and generally parallel thereto, the lower end of said inflow tank terminating above the lower ends of said outflow tanks and said space, whereby said bent tubes are in a higher position relative to the lower end of said inflow tank than relative to the lower ends of said outflow tanks.

3. Heat exchange device according to claim 1 or 2, wherein said device comprises a radiator for cooling engine water coolant.

4. Heat exchange device according to claim 1 or 2, wherein said device comprises an oil cooler for cooling engine lubricating oil.

5. Heat exchange device according to claim 1 or 2, wherein the cylinders of said power unit are distributed in a fore-and-aft arrangement, and said device is arranged to straddle the forward cylinders.

6. Heat exchange device according to claim 1 or 2, said device being made of aluminum.

7. Heat exchange device according to claim 1 or 2, wherein said space is sufficient to avoid the front wheel of said motorcycle hitting said device upon upward propulsion of the front wheel by which said front fork is supported, causing contraction of the latter.

* * * * *